US007438026B2

(12) United States Patent
Nakada et al.

(10) Patent No.: US 7,438,026 B2
(45) Date of Patent: Oct. 21, 2008

(54) CYLINDER BLOCK AND INTERNAL COMBUSTION ENGINE

(75) Inventors: Takanori Nakada, Toyota (JP); Makoto Hatano, Nagoya (JP)

(73) Assignees: Toyota Jidosha Kabushiki Kaisha, Toyota (JP); Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 11/896,892

(22) Filed: Sep. 6, 2007

(65) Prior Publication Data

US 2008/0060593 A1 Mar. 13, 2008

(30) Foreign Application Priority Data

Sep. 8, 2006 (JP) ..... 2006-244520

(51) Int. Cl.
*F02B 75/18* (2006.01)
*F02F 1/14* (2006.01)

(52) U.S. Cl. ..... 123/41.74

(58) Field of Classification Search ..... 123/41.72, 123/41.74, 41.81
See application file for complete search history.

(56) References Cited

U.S. PATENT DOCUMENTS 6,581,550 B2 6/2003 Shinpo et al.
6,834,625 B2 12/2004 Matsutani et al.
6,874,451 B2 4/2005 Matsutani et al.
7,032,547 B2 * 4/2006 Xin ..... 123/41.72
7,082,908 B2 8/2006 Matsutani et al.
7,216,611 B2 * 5/2007 Matsutani et al. ..... 123/41.72
7,278,380 B2 * 10/2007 Matsutani et al. ..... 123/41.74
7,278,381 B2 * 10/2007 Matsutani et al. ..... 123/41.74
2005/0268868 A1 * 12/2005 Kawai et al. ..... 123/41.31

FOREIGN PATENT DOCUMENTS

JP A 2005-113764 4/2005
JP A 2006-090196 4/2006

OTHER PUBLICATIONS

"Now Car Features—2006 Lexus GS300", EG-60 & EG-61, Jan. 2005.
Matsutani et al., "Water Jacket Spacer for Improvement of Cylinder Bore Temperature Distribution," *SAE Technical Paper Series*, 2005-01-1156, 2005 SAE World Congress, Detroit, Michigan, Apr. 11-14, 2005.

* cited by examiner

*Primary Examiner*—Hai H Huynh
(74) *Attorney, Agent, or Firm*—Oliff & Berridge, PLC

(57) ABSTRACT

In a cylinder block of an internal combustion engine, a water jacket in which coolant is circulated is formed around cylinder bores. In the cylinder block, an introduction passage, through which the coolant is introduced from the outside of the water jacket to the inside of the water jacket, is formed. A spacer, which extends along at least a portion of the periphery of the cylinder bores is provided in the water jacket. The spacer is disposed such that the inner wall surface of the spacer contacts the outer wall surfaces of the cylinder bores in an opening-side area of the cylinder block, where an opening of the introduction passage is formed, and the inner wall surface of the spacer does not contact the outer wall surfaces of the cylinder bores in an opposite opening-side area opposite to the opening-side area with respect to the cylinder bores.

12 Claims, 8 Drawing Sheets

CYLINDER BLOCK AND INTERNAL COMBUSTION ENGINE

INCORPORATION BY REFERENCE

The disclosure of Japanese Patent Application No. 2006-244520 filed on Sep. 8, 2006 including the specification, drawings and abstract is incorporated herein by reference in its entirety.

BACKGROUND OF THE INVENTION

1. Field of the Invention

The invention relates to a cylinder block and an internal combustion engine where a spacer that defines a flow passage for coolant is provided in a water jacket.

2. Description of the Related Art

Generally, an internal combustion engine includes a cylinder block in which cylinder bores are formed. A water jacket, which surrounds the cylinder bores, is formed in the cylinder block. An introduction passage, which connects the inside and the outside of the water jacket, is formed in the cylinder block. Coolant is introduced into the water jacket through the introduction passage. The internal combustion engine is cooled through heat transfer from the wall surface of the water jacket to the coolant flowing in the water jacket.

In the water jacket, the heat transfers to the coolant at an upstream side, and then the coolant flows into a downstream side in a direction in which the coolant flows (hereinafter, referred to as "coolant flow direction"). Therefore, cooling efficiency is likely to be low in the downstream-side area in the coolant flow direction. Thus, the temperature of the upstream-side area is lower than the temperature of the downstream-side area in the coolant flow direction. That is, the temperature is likely to differ between the areas of the cylinder block. For example, the cylinder bores may be unnecessarily deformed by the temperature difference, and as a result, friction may be increased.

Accordingly, for example, Japanese Patent Application Publication No. 2006-90196 (JP-A-2006-90196) describes a technology in which a spacer is provided in the water jacket. In the technology described in the publication No. 2006-90196, the spacer divides the space inside the water jacket into a portion near the cylinder bores and a portion near the outer wall of the cylinder block. In addition, a plurality of ribs, which protrudes, is provided on the inner wall of the spacer to throttle the flow of coolant in the gap between the inner wall of the spacer and the outer walls of cylinder bores. The width of the ribs increases toward the upstream side. In the cylinder block, the effect of throttling the flow of coolant, which is produced by the ribs, increases toward the upstream-side area in the coolant flow direction. Accordingly, the flow speed of the coolant decreases, and the cooling effect of the coolant decreases toward the upstream-side area in the coolant flow direction. By employing the configuration to adjust the cooling efficiency in each area of the cylinder block, it is possible to reduce the temperature difference between the areas of the cylinder block.

In the cylinder block described in the publication No. 2006-90196, the flow speed of the coolant differs between areas of the water jacket. Thus, it is possible to reduce the temperature difference between the areas of the cylinder block.

In the above-described cylinder block, after heat transfers to the coolant in the upstream-side area of the water jacket in the coolant flow direction, the coolant flows into the downstream-side area of the water jacket in the coolant flow direction. Accordingly, the cooling efficiency in the downstream-side area depends on how the heat transfers to the coolant in the upstream-side area.

Thus, in the above-described cylinder block, there is a limit to reduction of the temperature difference between the upstream-side area and the downstream-side area. That is, improvement needs to be made to reduce the temperature difference.

SUMMARY OF THE INVENTION

The invention provides a cylinder block in which a temperature difference between areas is appropriately reduced, and an appropriate internal combustion engine using the cylinder block.

Hereinafter, means for achieving the above object, and effects of the means will be described. A first aspect of the invention relates to a cylinder block that includes a cylinder bore; a water jacket that is formed around the cylinder bore so that coolant is circulated in the water jacket; an introduction passage, through which the coolant is introduced from an outside of the water jacket to an inside of the water jacket; and a spacer that is provided in the water jacket, and that extends along at least a portion of the periphery of the cylinder bore. In the cylinder block, the spacer is disposed such that an inner wall surface of the spacer contacts an outer wall surface of the cylinder bore in an opening-side area of the cylinder block, where an opening of the introduction passage is formed, and the inner wall surface of the spacer does not contact the outer wall surface of the cylinder bore in an opposite opening-side area of the cylinder block, which is opposite to the opening-side area with respect to the cylinder bore.

With the above-described configuration, in the opening-side area of the cylinder block, that is, in the area where the coolant is introduced into the water jacket, and the low-temperature coolant flows in the water jacket, the outer wall surfaces of the cylinder bores contact the inner wall surface of the spacer, and therefore, the gap between the outer wall surfaces of the cylinder bores and the inner wall surface of the spacer is reduced. Accordingly, it is possible to reduce the amount of coolant that passes through the gap, and contacts the outer wall surfaces of the cylinder bores. Further, in the opposite opening-side of the cylinder block, that is, in the area where the relatively-high temperature coolant flows in the water jacket, the outer wall surfaces of the cylinder bores do not contact the inner wall surface of the spacer, and therefore, the gap between the outer wall surfaces of the cylinder bores and the inner wall surface of the spacer is increased. Accordingly, a large amount of coolant passes through the gap and contacts the outer wall surfaces of the cylinder bores. Thus, it is possible to set the manner in which the coolant flows such that the cooling effect of the coolant is small in the opening-side area where the low-temperature coolant flows in the water jacket, and the cooling effect is large in the opposite opening-side area where the relatively-high temperature coolant flows in the water jacket. This appropriately reduces the temperature difference between the areas of the cylinder block.

In the cylinder block according to the above-described aspect, a plurality of the introduction passages may be formed. In the configuration where the plurality of the introduction passages is formed, the low-temperature coolant is introduced into the water jacket at a plurality of different positions, and the low-temperature coolant flows in a relatively large range in the opening-side area of the cylinder block. Thus, the cooling effect is likely to be excessively large in the opening-side area of the cylinder block. By employing the above-described configuration, the temperature difference between the opening-side area and the opposite opening-side area is appropriately reduced even in the cylinder block where the plurality of introduction passages is formed.

In the cylinder block according to the above-described aspect, a guard portion, which protrudes, may be provided on the outer wall surface of the spacer at a position that is farther from an engine combustion chamber than a portion of the outer wall surface of the spacer, which faces the opening, is.

With the above-described configuration, the guard portion interrupts the flow of the coolant toward the side opposite to the combustion chamber immediately after the coolant flows into the water jacket. This reduces the possibility that the coolant, which has flown into the water jacket, flows beyond the end of the spacer that is far from the engine combustion chamber, and contacts the outer wall surfaces of the cylinder bores, or flows into the gap between the outer wall surfaces of the cylinder bores and the inner wall surface of the spacer. Thus, it is possible to appropriately reduce the possibility that the opening-side area of the cylinder block is excessively cooled.

In the cylinder block according to the above-described aspect, a convex portion may be formed in the spacer at a position in the opposite opening-side area such that the convex portion protrudes from the inner wall surface of the spacer toward the outer wall surface of the cylinder bore.

With the above-described configuration, if the spacer is moved toward the opening-side area due to vibrations, the protruding end of the convex portion formed in the spacer contacts the outer wall surface of the cylinder bore in the opposite opening-side area of the cylinder block. Therefore, the gap between the outer wall surfaces of the cylinder bores and the inner wall surface of the spacer is maintained in the opposite opening-side area of the cylinder block. In addition, an increase in the gap is suppressed in the opening-side area of the cylinder block.

In the cylinder block according to the above-described aspect, the spacer may surround the cylinder bore.

With the above-described configuration, in the entire area surrounding the cylinder bores, the spacer divides the space inside the water jacket into the portion near the cylinder bores, and the portion near the outer wall of the cylinder block. Therefore, it is possible to appropriately suppress the flow of the coolant into the gap between the outer wall surfaces of the cylinder bores and the inner wall surface of the spacer in the opening-side area of the cylinder block. Thus, it is possible to appropriately reduce the possibility that the opening-side area of the cylinder block is excessively cooled.

A second aspect of the invention relates to an internal combustion engine that includes a cylinder block that includes a cylinder bore; a water jacket that is formed around the cylinder bore so that coolant is circulated in the water jacket; an introduction passage, through which the coolant is introduced from an outside of the water jacket to an inside of the water jacket; and a spacer that is provided in the water jacket, and that extends along at least a portion of the periphery of the cylinder bore. In the internal combustion engine, the spacer is disposed such that an inner wall surface of the spacer contacts an outer wall surface of the cylinder bore in an opening-side area of the cylinder block, where an opening of the introduction passage is formed, and the inner wall surface of the spacer does not contact the outer wall surface of the cylinder bore in an opposite opening-side area of the cylinder, which is opposite to the opening-side area with respect to the cylinder bore. In the second aspect, the cylinder block may be disposed such that the opening-side area is positioned above the opposite opening-side area in a vertical direction.

With the above-described configuration, the self weight of the spacer acts such that the spacer is pressed to the outer wall surfaces of the cylinder bores in the opening-side area of the cylinder block, and the spacer is separated from the outer wall surfaces of the cylinder bores in the opposite opening-side area of the cylinder block. Accordingly, with the above-described configuration, using the self weight of the spacer, the spacer is disposed such that the inner wall surface of the spacer contacts the outer wall surfaces of the cylinder bores in the opening-side area of the cylinder block, and the inner wall surface of the spacer does not contact the outer wall surfaces of the cylinder bores in the opposite opening-side area of the cylinder block.

In the internal combustion engine according to the above-described aspect, a plurality of the cylinder bores may be formed in a V-formation, and the opening of the introduction passage may be formed in each of areas of the cylinder block, which are positioned on both sides of a trough between both banks.

With the above-described configuration, in each bank of the V-type internal combustion engine, using the self weight of the spacer, the spacer is disposed such that the inner wall surface of the spacer contacts the outer wall surfaces of the cylinder bores in the opening-side area of the cylinder block, and the inner wall surface of the spacer does not contact the outer wall surfaces of the cylinder bores in the opposite opening-side area of the cylinder block.

The internal combustion engine according to the above-described aspect may further include a water pump that pressurizes coolant so that the coolant is delivered. A path that connects the water pump to a coolant passage in a cylinder head may differ from a path that connects the water pump to the water jacket.

In an internal combustion engine where the path that connects the water pump to the coolant passage in the cylinder head differs from the path that connects the water pump to the water jacket, the flow amount of coolant flowing in the water jacket per unit time is generally small, as compared to an internal combustion engine where the water pump is connected to the coolant passage and the water jacket via the same path, that is, an internal combustion engine where all the coolant supplied to the coolant passage passes through the water jacket. Therefore, the difference in the cooling effect between the opening-side area of the cylinder block and the opposite opening-side area of the cylinder block is likely to be large. Accordingly, the temperature difference between the opening-side area and the opposite opening-side area is also likely to be large.

With the above-described configuration, it is possible to appropriately reduce the temperature difference between the opening-side area of the cylinder block and the opposite opening-side area of the cylinder block in the internal combustion engine.

BRIEF DESCRIPTION OF THE DRAWINGS

The invention will become apparent from the following description of example embodiments with reference to the accompanying drawings, wherein like numerals are used to represent like elements and wherein.

DETAILED DESCRIPTION OF THE EMBODIMENTS

Figure 1:
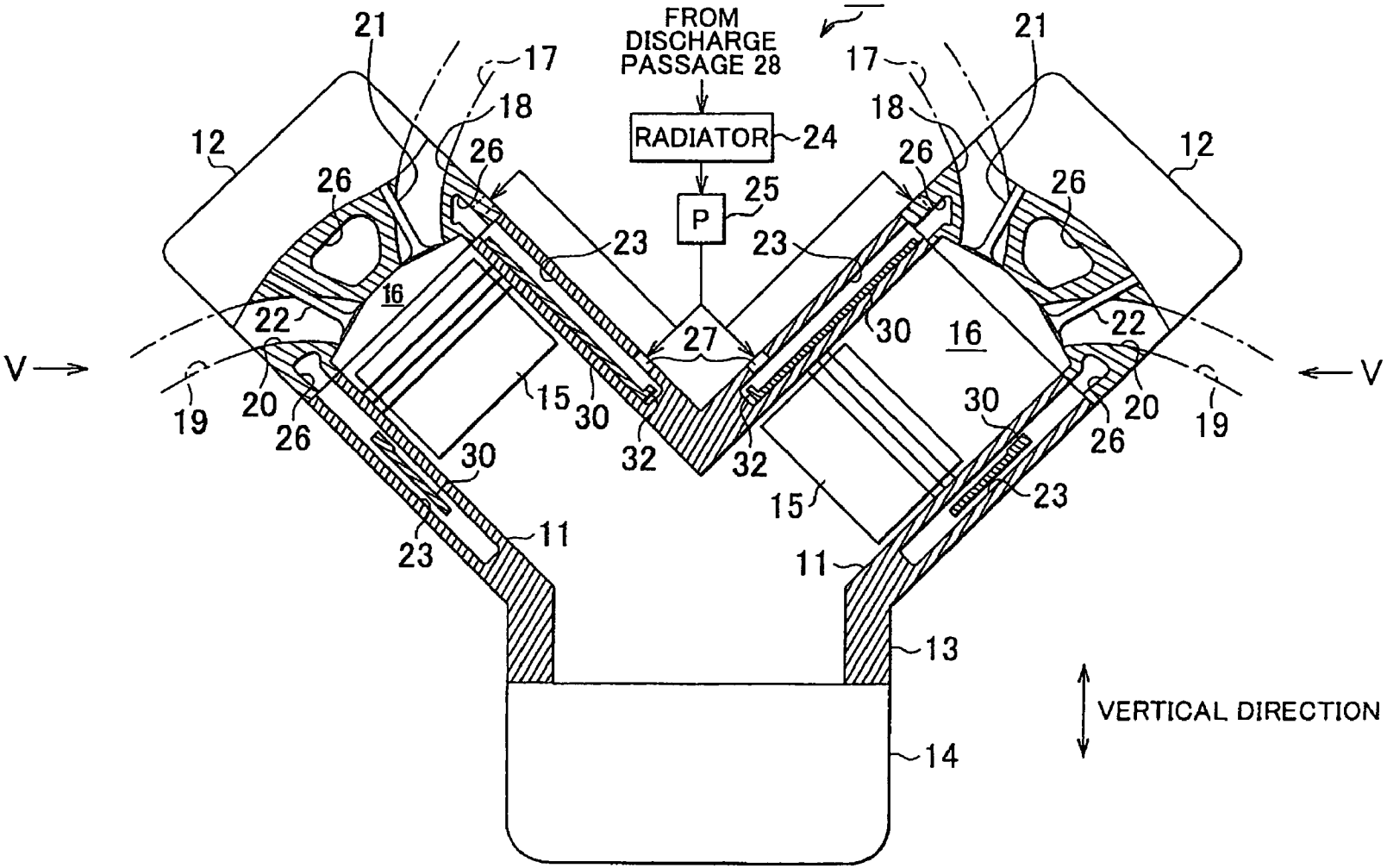
FIG. 1 is a schematic diagram showing the schematic configuration of an internal combustion engine according to an embodiment of the invention.

An embodiment of the invention will be described. FIG. 1 shows a schematic configuration of an internal combustion engine according to the embodiment. As shown in FIG. 1, the internal combustion engine 10 according to the embodiment includes two banks V. In each bank V, plural cylinder bores 11 are formed (four cylinder bores 11 are formed in the embodiment). The internal combustion engine 10 is a V-type internal combustion engine. The banks V are disposed in a V-formation such that a predetermined angle (90° in this embodiment) is formed between the two banks V.

The internal combustion engine 10 includes a cylinder head 12, a cylinder block 13, and a lower case 14. The cylinder head 12 constitutes the upper portion of the banks V. The cylinder block 13 is formed by integrating the lower portion of the banks V with the upper portion of a crank case. A lower case 14 constitutes the lower portion of the crank case of the internal combustion engine 10.

In the cylinder block 13, the cylinder bores 11 are formed. A piston 15 is provided to reciprocate in each cylinder bore 11. A combustion chamber 16 is defined by the cylinder bore 11, the cylinder head 12, and the piston 15.

In the cylinder head 12, intake ports 18 and exhaust ports 20 are formed. Each intake port 18 connects the combustion chamber 16 and an intake passage 17. Each exhaust port 20 connects the combustion chamber 16 and an exhaust passage 19. In the cylinder head 12, intake valves 21 and exhaust valves 22 are provided. Each intake valve 21 opens/closes the intake port 18. Each exhaust valve 22 opens/closes the exhaust port 20.

In the internal combustion engine 10 according to the embodiment, the intake ports 18 are formed in each of areas on the both sides of a trough between the both banks V (hereinafter, each of the areas will be referred to as "trough-side area"). The exhaust ports 20 are formed in an area opposite to each trough-side area with respect to the cylinder bores 11. The internal combustion engine 10 is disposed such that the intake port 18-side area of the bank V (i.e., the area where the intake ports 18 are formed) is positioned above the exhaust port 20-side area of the bank V (i.e., the area where the exhaust ports 20 are formed) in a vertical direction.

Water jackets 23 are formed in the cylinder block 13. Each water jacket 23 extends around the cylinder bores 11. After coolant is cooled through a radiator 24, the coolant is delivered under pressure by a water pump 25 to each water jacket 23 so that the coolant is circulated in each water jacket 23. The cylinder block 13 (particularly the peripheral portion of the cylinder bores 11) is cooled through heat transfer from the cylinder block 13 to the coolant.

Coolant passages 26 are formed in the cylinder head 12. The coolant is delivered under pressure by the water pump 25 also to each coolant passage 26 so that the coolant is circulated in each coolant passage 26. The cylinder head 12 is cooled through heat transfer from the cylinder head 12 to the coolant. Each coolant passage 26 extends in an area near the combustion chambers 16, the intake ports 18, and the exhaust ports 20 to cool the area near the combustion chambers 16, the intake ports 18, and the exhaust ports 20.

In the internal combustion engine 10 according to the embodiment, a path that connects the water pump 25 to the water jacket 23 differs from a path that connects the water pump 25 to the coolant passage 26. More specifically, the coolant is introduced into the water jacket 23 through introduction passages 27 formed in the cylinder block 13. The coolant is introduced into the coolant passage 26 through a bypass passage described later.

The water jacket 23 and the coolant passage 26 are connected to each other at a contact surface between the cylinder head 12 and the cylinder block 13. The coolant, which is introduced into the water jacket 23 through the introduction passages 27, passes through the water jacket 23, and then, flows into the coolant passage 26. A discharge passage 28, which connects the inside and the outside of the coolant passage 26, is formed in the trough-side area of the cylinder head 12. The discharge passage 28 is connected to the radiator 24. After the coolant passes through the water jacket 23 and the coolant passage 26, the coolant is returned to the radiator 24 through the discharge passage 28.

A spacer 30 is provided in each water jacket 23 to adjust the flow of the coolant. Hereinafter, the cooling structure for cooling the internal combustion engine 10 will be described in detail.

Figure 2:
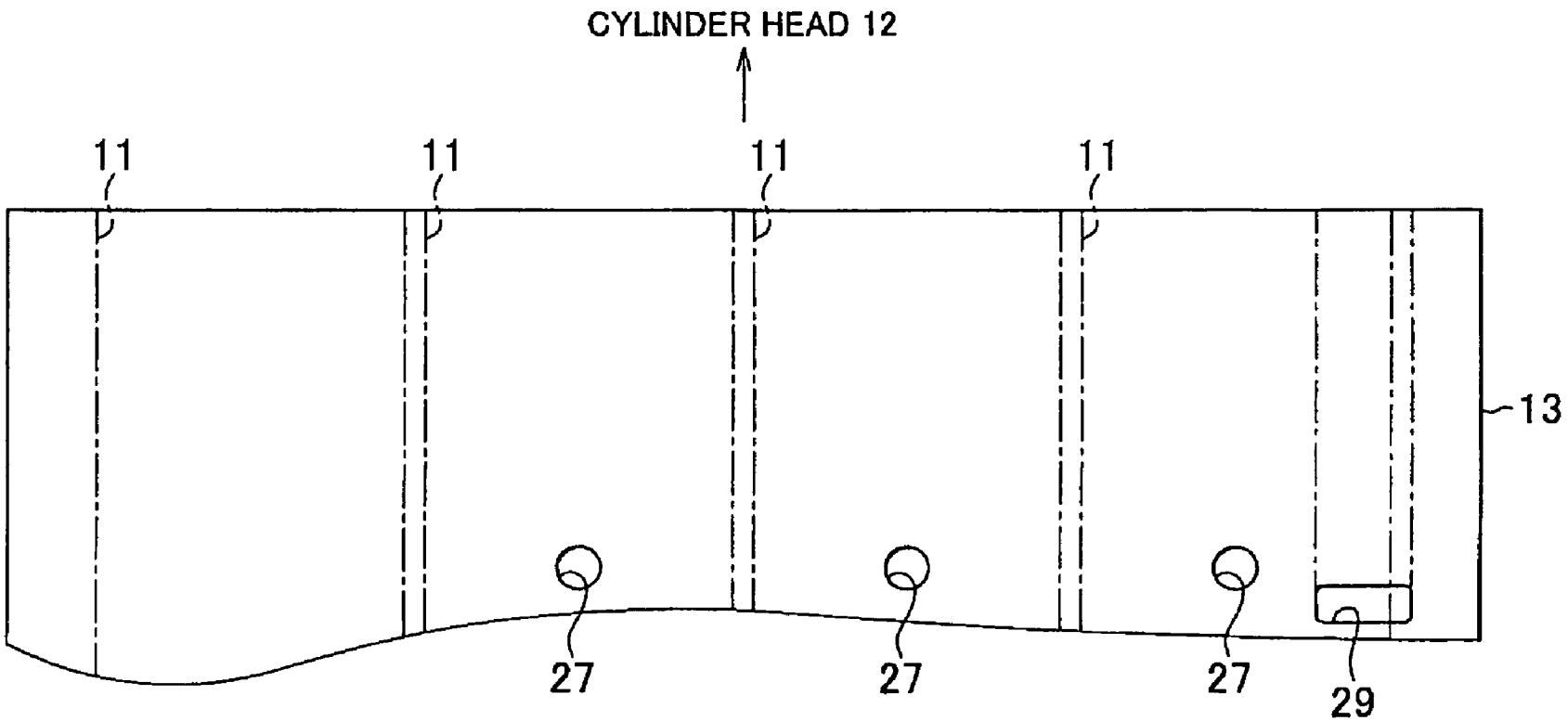
FIG. 2 is a diagram showing the structure of a portion of a cylinder block, which constitutes a bank, and which is viewed from the side of a trough between the both banks.

Both the banks V of the internal combustion engine 10 have the same basic structure. Therefore, hereinafter, only one bank V will be described. FIG. 2 shows the structure of a portion of the cylinder block 13, which constitutes the bank V, and which is viewed from the side of the trough between the both banks V.

As shown in FIG. 2, a plurality of the introduction passages 27 is formed in the bank V. More specifically, the introduction passages 27 are formed in positions corresponding to a plurality of cylinder bores 11 (i.e., the three cylinder bores 11 excluding one cylinder bore 11 in the bank V in the embodiment).

The bypass passage 29 is formed in the bank V. The bypass passage 29 opens in the trough-side area, and opens at an end on the cylinder head 12-side. The coolant is supplied to the coolant passage 26 in the cylinder head 12 through the bypass passage 29.

Figure 3:
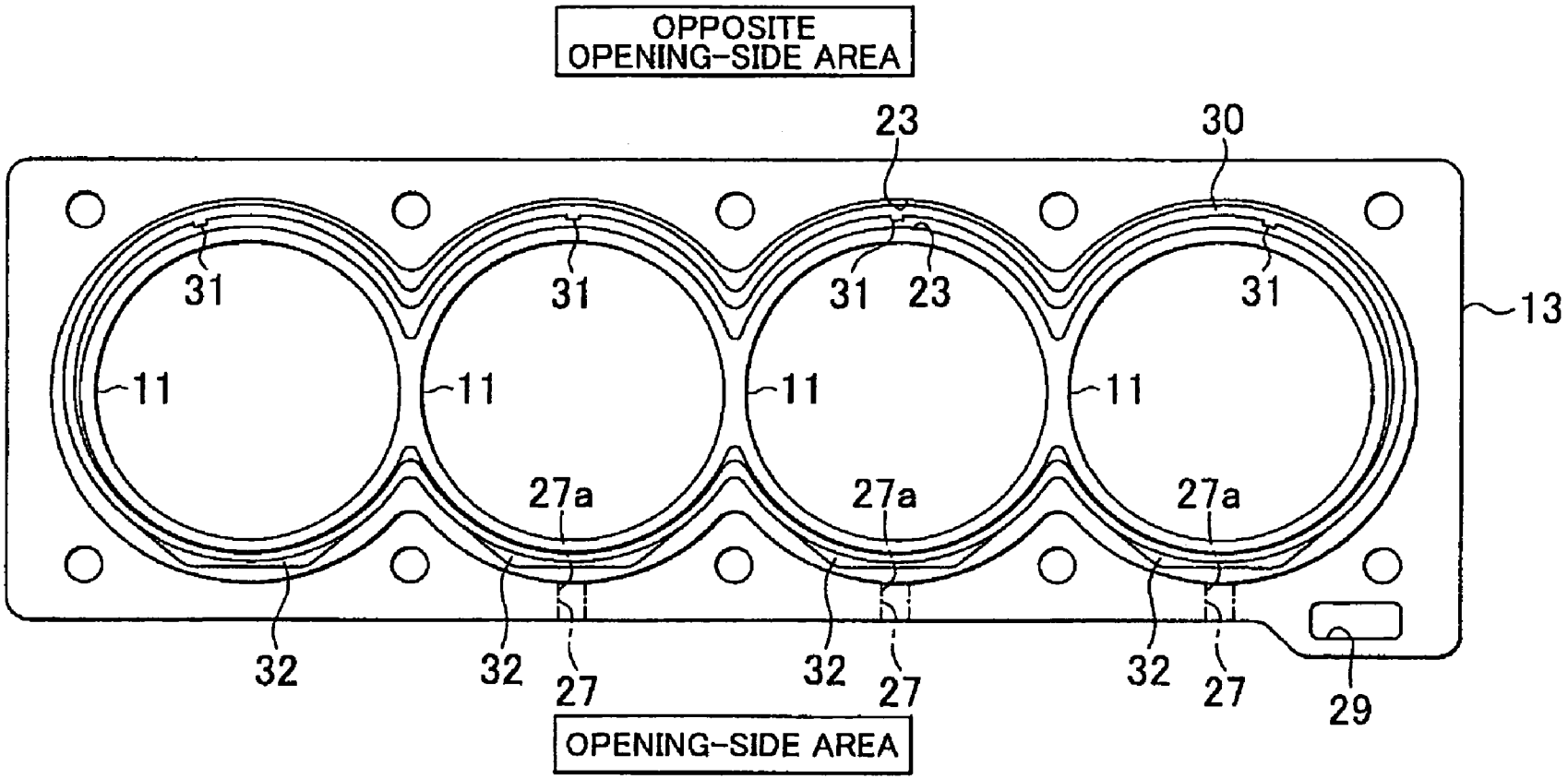
FIG. 3 is a diagram showing the structure of a portion of the cylinder block, which constitutes the bank, and which is viewed from the side of a cylinder head.

FIG. 3 shows the structure of a portion of the cylinder block, which constitutes the bank V, and which is viewed from the side of the cylinder head 12. As shown in FIG. 3, the spacer 30 extends to surround all the cylinder bores 11 in one bank V. The inner wall surface of the spacer 30 extends along the outer wall surfaces of the cylinder bores 11, which face the inner wall surface of the spacer 30. The inner wall surface of the spacer 30 is slightly larger than the outer wall surfaces of the cylinder bores 11. Each introduction passage 27 extends such that an opening 27*a* near the water jacket 23 (hereinafter, referred to as "opening 27*a* on the water jacket 23-side") is formed in the intake port 18-side area of the bank V.

Figure 4:
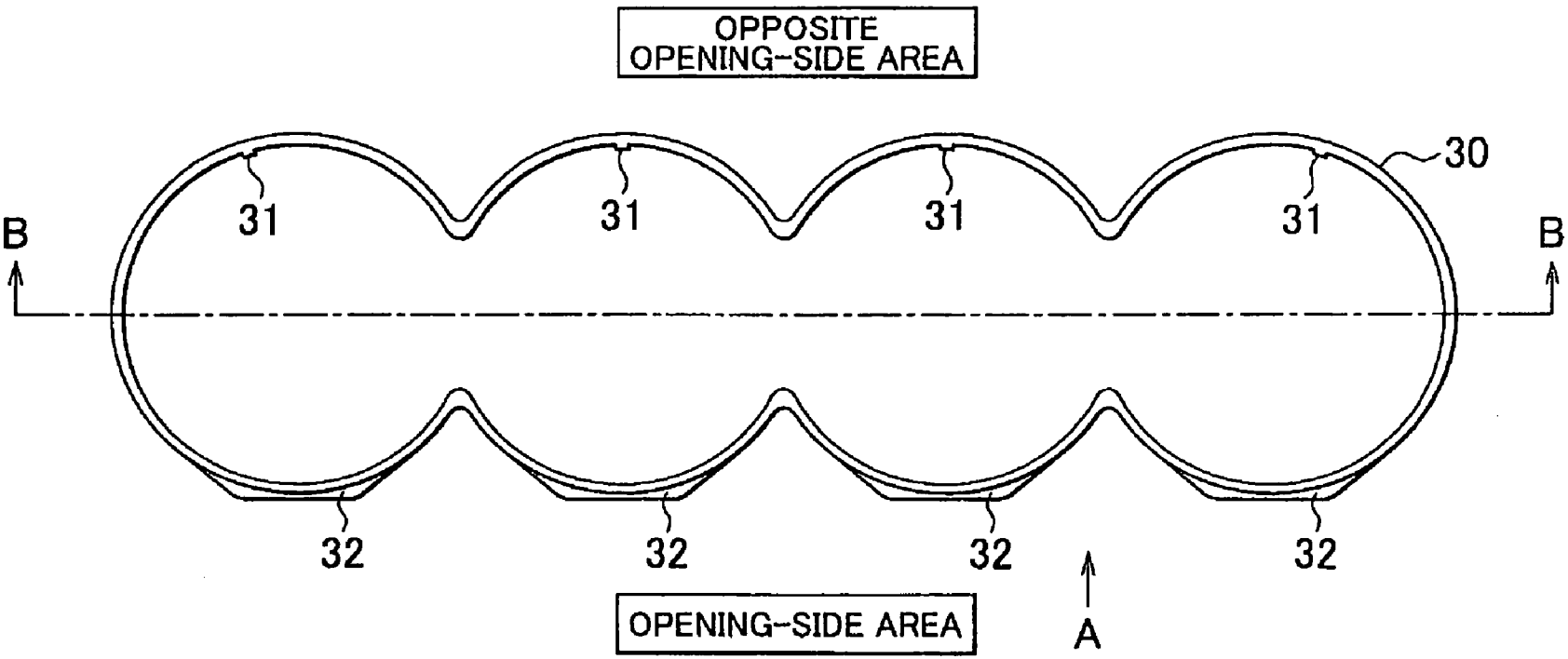
FIG. 4 is a diagram showing the structure of a spacer, which is viewed from the side of the cylinder head.

FIG. 4 shows the structure of the spacer 30, which is viewed from the side of the cylinder head 12. As shown in FIG. 4, a plurality of convex portions 31 is formed on the inner wall surface of the spacer 30 such that the plurality of convex portions 31 protrudes from the inner wall surface. The convex portions 31 are formed in the spacer 30 at positions in the exhaust port 20-side area of the bank V. That is, the convex portions 31 are formed in an area of the bank V (opposite opening-side area of the bank V) opposite to an opening-side area of the bank V where the openings 27*a* are formed, with respect to the cylinder bores 11. Each convex portion 31 is formed to face the outer wall surface of a corresponding one of the plurality of cylinder bores 11 (all the cylinder bores 11 in the embodiment).

A plurality of guard portions 32, which protrudes, is formed on the outer wall surface of the spacer 30. Guard portions 32 are formed in the spacer 30 at positions that are in the opening-side area of the cylinder block 13, and that correspond to the respective cylinder bores 11 (all the cylinder bores 11 in the embodiment).

Figure 5:
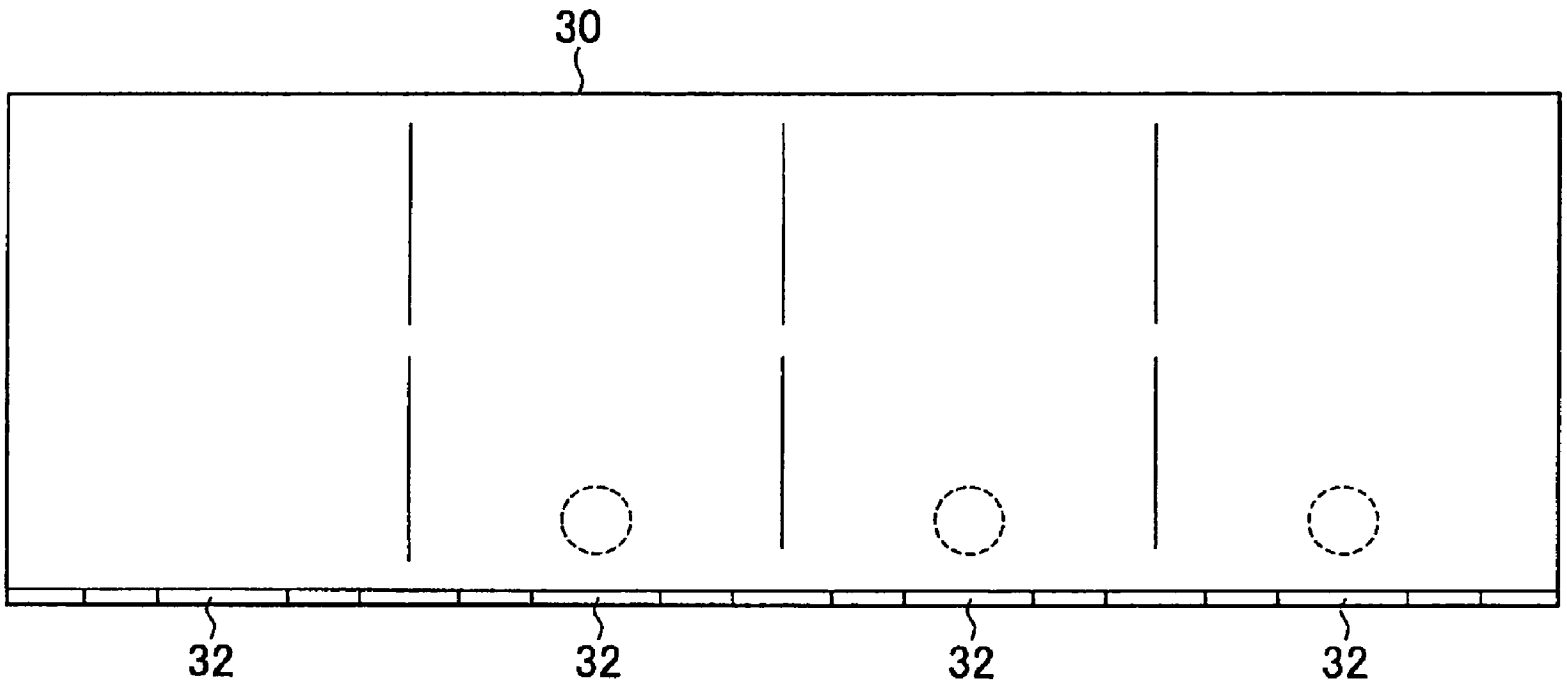
FIG. 5 is a diagram showing the structure of the spacer, which is viewed in the direction shown by the arrow A in FIG. 4.

FIG. 5 shows the structure of the spacer 30 viewed in the direction shown by the arrow A. As shown in FIG. 5, each guard portion 32 is formed at an end of the spacer 30 (i.e., the bottom end of the spacer 30 in FIG. 5) that is farther from the combustion chamber 16 than a portion of the spacer (i.e., the portion shown by the dashed line in FIG. 5) that faces the opening 27*a* of the introduction passage 27 on the water jacket 23-side is (refer to FIG. 3).

The portion of the spacer 30, which is disposed in the opening-side area, has a large width in the central axis direction of the cylinder bores 11 (i.e., the vertical direction in FIG. 5) so that the portion of the spacer 30 covers the substantially entire outer wall surfaces of the cylinder bores 11.

Figure 6:
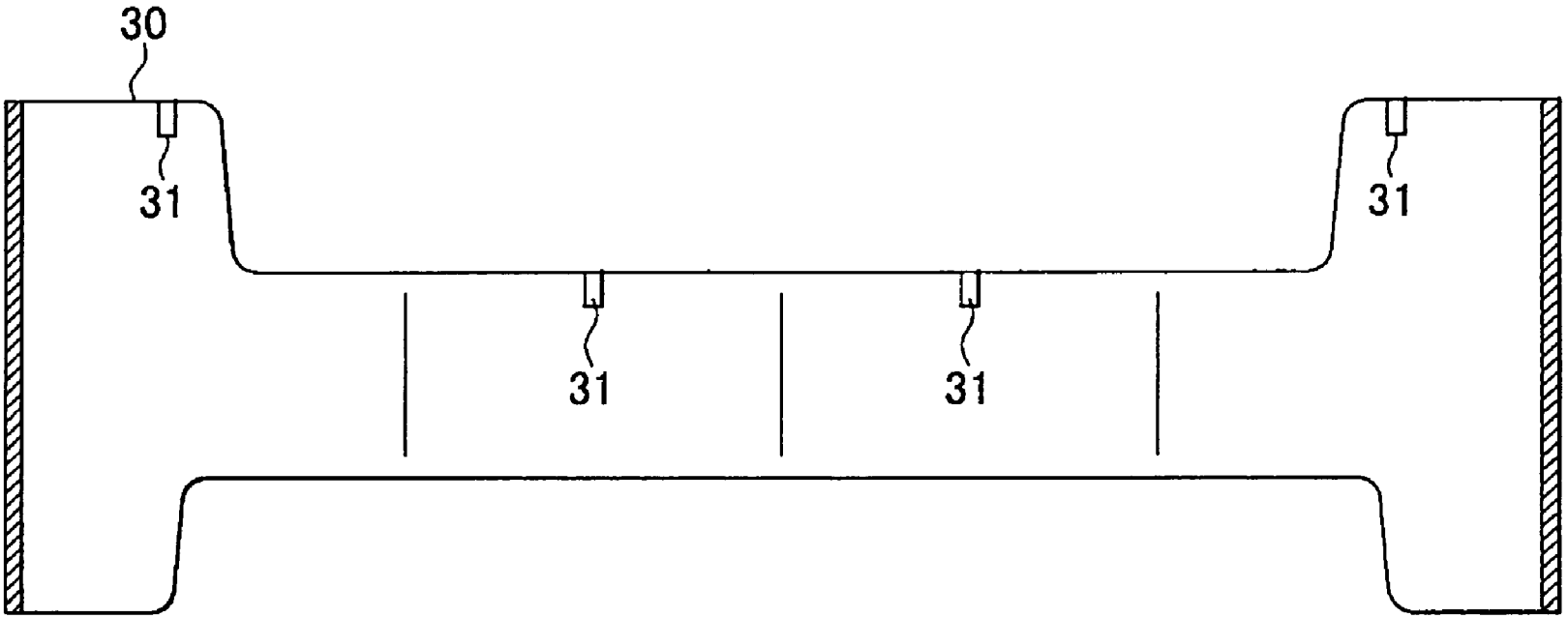
FIG. 6 is a cross sectional view showing the cross sectional structure of the spacer, taken along the line B-B.

FIG. 6 shows the cross sectional structure of the spacer 30, taken along the line B-B in FIG. 4. As shown in FIG. 6, the portion of the spacer 30, which is disposed in the opposite opening-side area, has a small width in the central axis direction of the cylinder bores 11. Therefore, in the opposite opening-side area of the water jacket 23, the coolant flowing in a portion on the outer peripheral side of the spacer 30 is likely to flow into a portion on the inner peripheral side of the spacer 30, that is, the coolant is likely to contact the outer peripheral surfaces of the cylinder bores 11.

Figure 7:
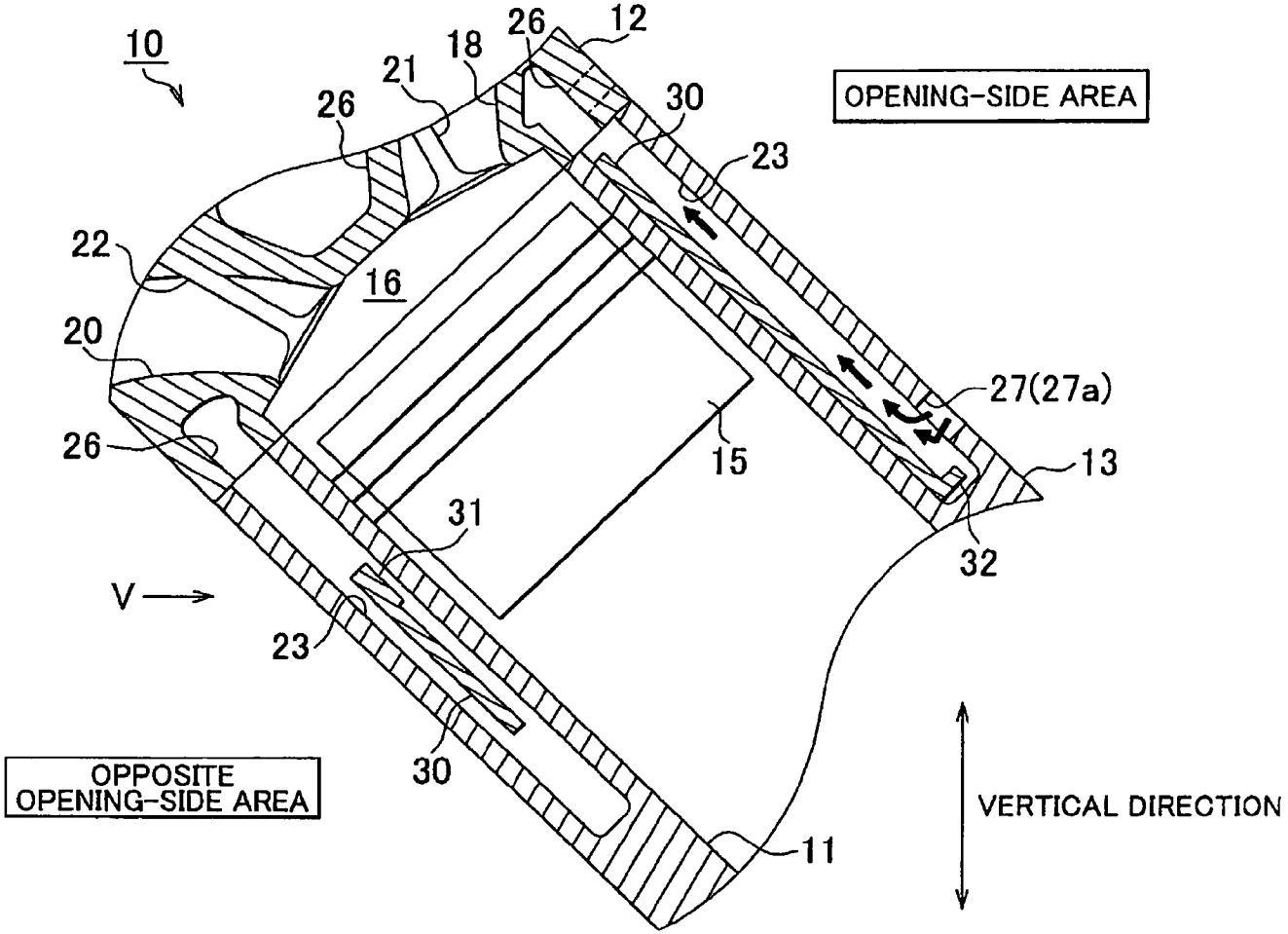
FIG. 7 is a schematic diagram schematically showing the manner in which the coolant flows near a cylinder bore.

Hereinafter, advantageous effects obtained by employing the above-described cooling structure will be described. FIG. 7 schematically shows the manner in which the coolant flows near the cylinder bore 11. In FIG. 7, the arrows show the direction in which the coolant flows.

As shown in FIG. 7, in the internal combustion engine 10, the opening-side area of the cylinder block 13 is positioned above the opposite opening-side area of the cylinder block 13 in the vertical direction in each bank V. Therefore, the self weight of the spacer 30 provided in the water jacket 23 acts such that the spacer 30 is pressed to the outer wall surfaces of the cylinder bores 11 in the opening-side area of the cylinder block 13, and the spacer 30 is separated from the outer wall surfaces of the cylinder bores 11 in the opposite opening-side area of the cylinder block 13. As a result, the inner wall surface of the spacer 30 contacts the outer wall surfaces of the cylinder bores 11 in the opening-side area of the cylinder block 13, while the inner wall surface of the spacer 30 does not contact the outer wall surfaces of the cylinder bores 11 in the opposite opening-side area of the cylinder block 13. Also, because the openings 27*a* of the introduction passages 27 are formed in the opening-side area of the cylinder block 13, the flow of the coolant flowing into the water jacket 23 through the introduction passages 27 presses the spacer 30 to the outer wall surfaces of the cylinder bores 11 in the opening-side area.

Thus, in the opening-side area of the cylinder block 13, that is, the area where the coolant is introduced into the water jacket 23, and the low-temperature coolant flows in the water jacket 23, the gap between the outer wall surfaces of the cylinder bores 11 and the inner wall surface of the spacer 30 is extremely small, and the coolant hardly passes through the gap. In contrast, in the opposite opening-side area of the cylinder block 13, that is, the area where the relatively high-temperature coolant flows in the water jacket 23, the gap between the outer wall surfaces of the cylinder bores 11 and the inner wall surface of the spacer 30 is large, and therefore, a large amount of coolant passes through the gap, and contacts the outer wall surfaces of the cylinder bores 11.

Thus, the manner in which the coolant flows is set such that the cooling effect of the coolant is small in the opening-side area where the low-temperature coolant flows in the water jacket 23, and the cooling effect is large in the opposite opening-side area where the relatively-high temperature coolant flows in the water jacket 23. This reduces the temperature difference between the opening-side area of the cylinder block 13 and the opposite opening-side area of the cylinder block 13.

Also, because the guard portions 32 are formed in the spacer 30, the guard portions 32 interrupt the flow of the coolant toward the side opposite to the combustion chamber 16 immediately after the coolant flows into the water jacket 23 through the introduction passages 27. This reduces the possibility that the coolant, which has flown into the water jacket 23, flows beyond the end of the spacer 30 that is far from the combustion chamber 16, and contacts the outer wall surfaces of the cylinder bores 11, or flows into the gap between the outer wall surfaces of the cylinder bores 11 and the inner wall surface of the spacer 30. Thus, it is possible to appropriately reduce the possibility that the opening-side area of the cylinder block 13 is excessively cooled.

If the periphery of the spacer 30 includes a discontinuous portion disposed in or near the opening-side area of the cylinder block 13, the coolant is likely to flow into the gap between the outer wall surfaces of the cylinder bores 11 and the inner wall surface of the spacer 30 through the discontinuous portion of the periphery of the spacer 30, in the internal combustion engine 10.

In the embodiment, the spacer 30, which extends to surround the cylinder bores 11, is provided. In the entire area surrounding the cylinder bores 11, the spacer 30 divides the space inside the water jacket 23 into a portion near the cylinder bores 11, and a portion near the outer wall of the cylinder block 13. Thus, because the spacer 30 in the embodiment does not include the above-described discontinuous portion, it is possible to appropriately suppress the flow of the coolant into the gap between the outer wall surfaces of the cylinder bores 11 and the inner wall surface of the spacer 30 in the opening-side area of the cylinder block 13.

Also, the convex portions 31 are formed on the inner wall surface of the spacer 30 at the positions in the opposite opening-side area. Therefore, if the spacer 30 is temporarily moved toward the opening-side area due to vibrations of the internal combustion engine 10, the protruding ends of the convex portions 31 of the spacer 30 contact the outer wall surfaces of the cylinder bore 11. This avoids a situation where the inner wall surface of the spacer 30 contacts the outer wall surfaces of the cylinder bores 11. Accordingly, the gap between the outer wall surfaces of the cylinder bores 11 and the inner wall surface of the spacer 30 is maintained in the opposite opening-side area of the cylinder block 13. In addition, an increase in the gap between the outer wall surfaces of the cylinder bores 11 and the inner wall surface of the spacer 30 is suppressed in the opening-side area of the cylinder block 13.

In the internal combustion engine 10, the relatively low-temperature coolant, which is delivered under pressure by the water pump 25, is directly introduced into the water jacket 23 from the outside of the water jacket 23 through the plurality of introduction passages 27 formed at different positions. Therefore, in the internal combustion engine 10, the low-temperature coolant flows in the relatively large range in the area of the water jacket 23, which is formed in the opening-side area of the cylinder block 13. Thus, the cooling effect in the opening-side area of the cylinder block 13 is more likely to be large.

Further, in the internal combustion engine 10, the path that connects the water pump 25 to the coolant passage 26 differs from the path that connects the water pump 25 to the water jacket 23. Therefore, as compared to an internal combustion engine where the water pump 25 is connected to the coolant passage 26 and the water jacket 23 via the same path, that is, an internal combustion engine where all the coolant supplied to the coolant passage 26 passes through the-water jacket 23, the flow amount of coolant flowing in the water jacket 23 per unit time is small. Thus, the difference in the cooling effect between the opening-side area of the cylinder block 13 and the opposite opening-side area of the cylinder block 13 is likely to be large. Accordingly, the temperature difference between the opening-side area of the cylinder block 13 and the opposite opening-side area of the cylinder block 13 is also likely to be large.

Figure 8:
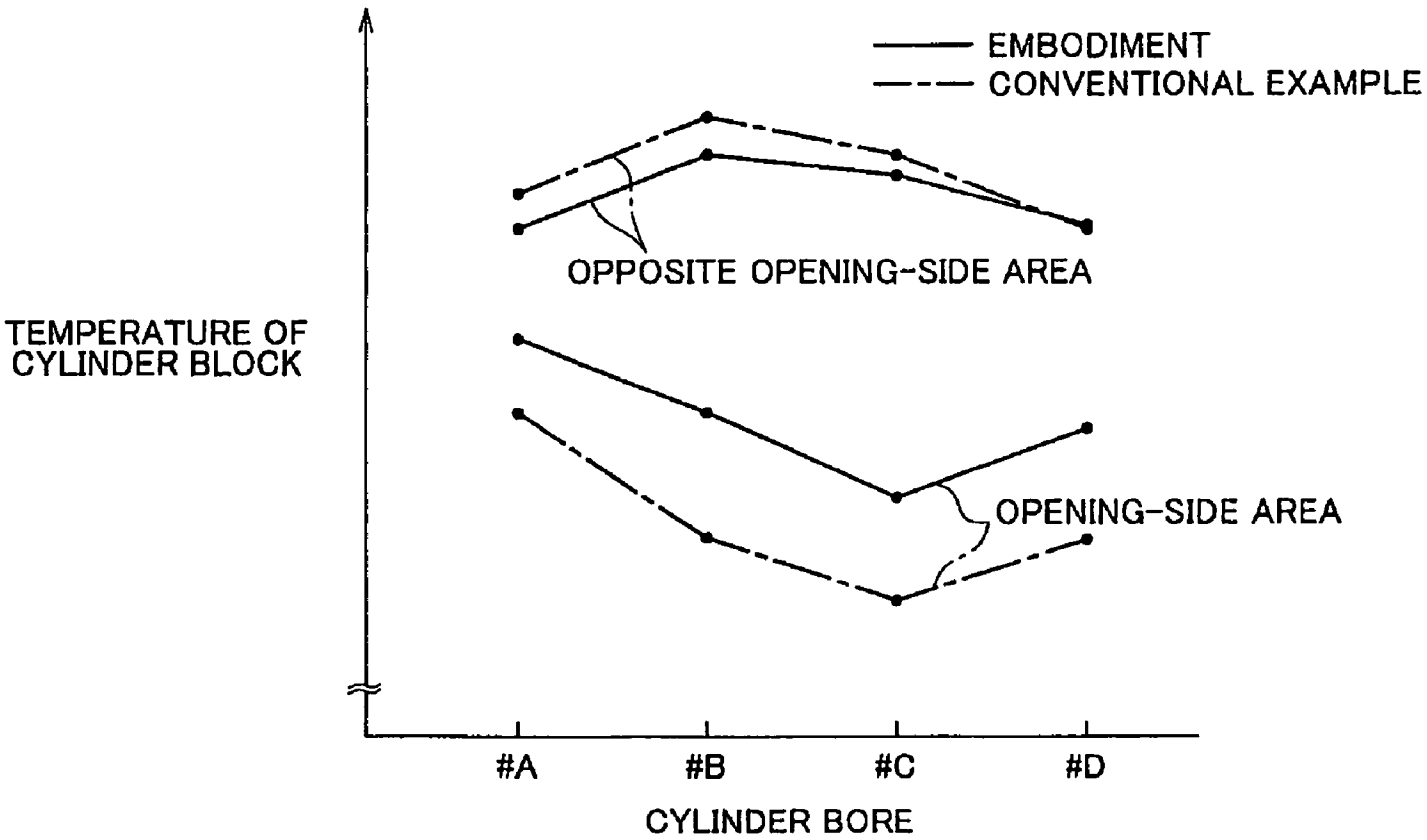
FIG. 8 is a schematic diagram showing the results of measurement of the temperatures of the opening-side area of the cylinder block and the temperatures of the opposite opening-side area of the cylinder block.

According to the embodiment, even in the internal combustion engine 10, it is possible to appropriately reduce the temperature difference between the opening-side area of the cylinder block 13 and the opposite opening-side area of the cylinder block 13. FIG. 8 shows the results of measurement of the cylinder block temperatures. More specifically, FIG. 8 shows the temperatures of the opening-side area of the cylinder bore 11 and the temperatures of the opposite opening-side area of the cylinder bore 11, which are measured at portions corresponding to the cylinder bores 11 formed in one bank V.

In FIG. 8, the solid lines show the results of the measurement in the internal combustion engine 10 according to the embodiment. The dashed-dotted lines show the results of the measurement in a conventional internal combustion engine where the above-described spacer 30 is not provided.

As shown in FIG. 8, in the internal combustion engine 10 according to the embodiment, the temperatures of the opening-side area of the cylinder bore 13 are high, but the temperatures of the opposite opening-side area of the cylinder block 13 are low, as compared to the conventional internal combustion engine. The difference between the temperature of the opening-side area of the cylinder block 13 and the temperature of the opposite opening-side area of the cylinder block 13, which are measured at the portions corresponding to each cylinder bore 11, is reduced, as compared to the conventional internal combustion engine. Further, the difference between the temperature of the opening-side area and the temperature of the opposite opening-side area in the entire cylinder block 13 is also reduced. Thus, in the internal combustion engine 10, the temperature difference between the areas of the cylinder block 13 is reduced, as compared to the conventional internal combustion engine.

As described above, according to the embodiment, it is possible to obtain advantageous effects described below. (1) The spacer 30 is disposed such that the inner wall surface of the spacer 30 contacts the outer wall surfaces of the cylinder bores 11 in the opening-side area of the cylinder block 13, and the inner wall surface of the spacer 30 does not contact the outer wall surfaces of the cylinder bores 11 in the opposite opening-side area of the cylinder block 13. Therefore, the manner in which the coolant flows is set such that the cooling effect of the coolant is small in the opening-side area where the low-temperature coolant flows in the water jacket 23, and the cooling effect is large in the opposite opening-side area where the relatively high-temperature coolant flows in the water jacket 23. This reduces the temperature difference between the opening-side area of the cylinder block 13 and the opposite opening-side area of the cylinder block 13.

(2) It is possible to appropriately reduce the temperature difference between the opening-side area of the cylinder block 13 and the opposite opening-side area of the cylinder block 13 in the internal combustion engine 10 where the cooling effect is likely to be large in the opening-side area of the cylinder block 13 because the plurality of introduction passages 27 is formed in the opening-side area.

(3) The guard portions 32, which protrude, are provided on the outer wall surface of the spacer 30 at the positions that are farther from the combustion chambers 16 than the portions of the spacer 30, which face the openings 27*a*, are. This reduces the possibility that the coolant, which has flown into the water jacket 23, flows beyond the end of the spacer 30 that is far from the combustion chamber 16, and contacts the outer wall surfaces of the cylinder bores 11, or flows into the gap between the outer wall surfaces of the cylinder bores 11 and the inner wall surface of the spacer 30. Thus, it is possible to appropriately reduce the possibility that the opening-side area of the cylinder block 13 is excessively cooled.

(4) The convex portions 31 are formed on the inner wall surface of the spacer 30 to protrude from the inner wall surface at the positions in the opposite opening-side area. Therefore, the gap between the outer wall surfaces of the cylinder bores 11 and the inner wall surface of the spacer 30 is maintained in the opposite opening-side area of the cylinder block 13. In addition, an increase in the gap between the outer wall surfaces of the cylinder bores 11 and the inner wall surface of the spacer 30 is suppressed in the opening-side area of the cylinder block 13.

(5) The spacer 30 is formed to surround the cylinder bores 11. Therefore, it is possible to appropriately suppress the flow of the coolant into the gap between the outer wall surfaces of the cylinder bores 11 and the inner wall surface of the spacer 30 in the opening-side area of the cylinder block 13. Thus, it is possible to appropriately reduce the temperature difference between the opening-side area of the cylinder block 13 and the opposite opening-side area of the cylinder block 13.

(6) The cylinder block 13 is disposed such that the opening-side area is positioned above the opposite opening-side area in the vertical direction. Therefore, using the self weight of the spacer 30, the spacer 30 is disposed such that the inner wall surface of the spacer 30 contacts the outer wall surfaces of the cylinder bores 11 in the opening-side area of the cylinder block 13, and the inner wall surface of the spacer 30 does not contact the outer wall surfaces of the cylinder bores 11 in the opposite opening-side area of the cylinder block 13.

(7) The trough-side area is the opening-side area of the cylinder block 13. The area opposite to the trough-side area with respect to the cylinder bores 11 is the opposite opening-side area of the cylinder block 13. Therefore, in each bank V, using the self weight of the spacer 30, the spacer 30 is disposed such that the inner wall surface of the spacer 30 contacts the outer wall surfaces of the cylinder bores 11 in the opening-side area of the cylinder block 13, and the inner wall surface of the spacer 30 does not contact the outer wall surfaces of the cylinder bores 11 in the opposite opening-side area of the cylinder block 13.

(8) The path that connects the water pump 25 to the coolant passage 26 differs from the path that connects the water pump 25 to the water jacket 23. Therefore, it is possible to appropriately reduce the temperature difference between the opening-side area of the cylinder block 13 and the opposite opening-side area of the cylinder block 13 in the internal combustion engine 10 where the temperature difference is likely to be large.

The above-described embodiments may be modified as follows. The position in the spacer 30 where each convex portion 31 is formed may be changed to any position, and the number of the convex portions 31 may be changed to any number, as long as each convex portion is formed at a position in the opposite opening-side area of the cylinder block 13. The convex portion 31 may be omitted.

The position in the spacer 30 where each guard portion 32 is formed is not limited to the end far from the combustion chamber 16. The position where each guard portion 32 is formed may be appropriately changed, as long as the position is farther from the combustion chamber 16 than the portion of the spacer 30 that faces the opening 27*a* of the introduction passage 27 on the water jacket 23-side is. The guard portions 32 do not necessarily need to be formed at the positions corresponding to the respective cylinder bores 11. For example, a guard portion may be formed to extend over the outer wall surfaces of the plurality of cylinder bores 11. It is essential only that the guard portion 32 should interrupt the flow of the coolant toward the side opposite to the combustion chamber 16 immediately after the coolant flows into the water jacket 23 through the introduction passage 27. The guard portion may be omitted.

The spacer 30 that surrounds the cylinder bores 11 does not necessarily need to be provided. A spacer whose periphery is partly discontinuous may be provided.

The spacer 30 may be fixed in the water jacket 23 by pressing the spacer 30 into the water jacket 23. This configuration is implemented by newly providing a convex portion on the inner wall surface or the outer wall surface of the spacer 30, or the wall surface of the water jacket 23.

The invention may be applied to an internal combustion engine where only one introduction passage 27 is formed, or an internal combustion engine where the introduction passages 27 are formed in the exhaust port 20-side area of the cylinder block 13.

The invention may be applied to an internal combustion engine where the opening-side area of the cylinder block is positioned below the opposite opening-side area of the cylinder block in the vertical direction, or an internal combustion engine where the opening-side area and the opposite opening-side area of the cylinder block are positioned at the same height in the vertical direction, as long as the spacer 30 is disposed in the water jacket 23 at a fixed position in the internal combustion engine. Further, the invention may be applied to an internal combustion engine where the trough-side area is the opposite opening-side area of the cylinder block, and the area opposite to the trough-side area with respect to the cylinder bores is the opening-side area, as long as the spacer 30 is disposed in the water jacket 23 at a fixed position in the internal combustion engine.

The invention may be applied to an internal combustion engine where all the coolant supplied to the coolant passage in the cylinder head passes through the water jacket, that is, an internal combustion engine where the water jacket and the coolant passage are connected to the water pump via the same path.

The invention may be applied to an internal combustion engine other than the internal combustion engine where the cylinder bores are disposed in a V-formation, for example, an internal combustion engine where the cylinder bores are disposed in a line. Also, the invention may be applied to internal combustion engines that include one to seven cylinders, or nine or more cylinders.

What is claimed is:

1. A cylinder block comprising:

a cylinder bore;

a water jacket that is formed around the cylinder bore so that coolant is circulated in the water jacket;

an introduction passage, through which the coolant is introduced from an outside of the water jacket to an inside of the water jacket; and a spacer that is provided in the water jacket, and that extends along at least a portion of a periphery of the cylinder bore, wherein the spacer is disposed such that an inner wall surface of the spacer contacts an outer wall surface of the cylinder bore in an opening-side area of the cylinder block, where an opening of the introduction passage is formed, and the inner wall surface of the spacer does not contact the outer wall surface of the cylinder bore in an opposite opening-side area of the cylinder block, which is opposite to the opening-side area with respect to the cylinder bore.

2. The cylinder block according to claim 1, wherein the opening-side area is positioned above the opposite opening-side area in a vertical direction, in the cylinder block.

3. The cylinder block according to claim 2, wherein a plurality of the cylinder bores is disposed in a V-formation, and the opening of the introduction passage is formed in each of areas of the cylinder block, which are positioned on both sides of a trough between both banks.

4. The cylinder block according to claim 1, wherein a plurality of the introduction passages is formed.

5. The cylinder block according to claim 1, wherein a guard portion, which protrudes, is provided on an outer wall surface of the spacer at a position that is farther from an engine combustion chamber than a portion of the outer wall surface of the spacer, which faces the opening, is.

6. The cylinder block according to claim 1, wherein a convex portion is formed in the spacer at a position in the opposite opening-side area such that the convex portion protrudes from the inner wall surface of the spacer toward the outer wall surface of the cylinder bore.

7. The cylinder block according to claim 1, wherein the spacer surrounds the cylinder bore.

8. The cylinder block according to claim 1, wherein an area of the spacer, which faces the outer wall surface of the cylinder bore, in the opposite opening-side area is smaller than an area of the spacer, which faces the outer wall surface of the cylinder bore, in the opening-side area.

9. An internal combustion engine comprising:

a cylinder block that includes a cylinder bore; a water jacket that is formed around the cylinder bore so that coolant is circulated in the water jacket; an introduction passage, through which the coolant is introduced from an outside of the water jacket to an inside of the water jacket; and a spacer that is provided in the water jacket, and that extends along at least a portion of a periphery of the cylinder bore, wherein the spacer is disposed such that an inner wall surface of the spacer contacts an outer wall surface of the cylinder bore in an opening-side area of the cylinder block, where an opening of the introduction passage is formed, and the inner wall surface of the spacer does not contact the outer wall surface of the cylinder bore in an opposite opening-side area of the cylinder block, which is opposite to the opening-side area with respect to the cylinder bore.

10. The internal combustion engine according to claim 9, wherein the cylinder block is disposed such that the opening-side area is positioned above the opposite opening-side area in a vertical direction.

11. The internal combustion engine according to claim 10, wherein a plurality of the cylinder bores is formed in a V-formation, and the opening of the introduction passage is formed in each of areas of the cylinder block, which are positioned on both sides of a trough between both banks.

12. The internal combustion engine according to claim 9, further comprising a water pump that pressurizes coolant so that the coolant is delivered, wherein a path that connects the water pump to a coolant passage in a cylinder head differs from a path that connects the water pump to the water jacket.

* * * * *